US009587181B2

(12) United States Patent
Lehrer et al.

(10) Patent No.: US 9,587,181 B2
(45) Date of Patent: Mar. 7, 2017

(54) SYNERGISTIC H2S SCAVENGER COMBINATION OF TRANSITION METAL SALTS WITH WATER-SOLUBLE ALDEHYDES AND ALDEHYDE PRECURSORS

(71) Applicant: Baker Hughes Incorporated, Houston, TX (US)

(72) Inventors: Scott E. Lehrer, The Woodlands, TX (US); Vladimir Jovancicevic, Richmond, TX (US); Sunder Ramachandran, Sugar Land, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 252 days.

(21) Appl. No.: 14/149,008

(22) Filed: Jan. 7, 2014

(65) Prior Publication Data

US 2014/0190870 A1 Jul. 10, 2014

Related U.S. Application Data

(60) Provisional application No. 61/750,973, filed on Jan. 10, 2013.

(51) Int. Cl.

| | |
|---|---|
| ***C10G 29/00*** | (2006.01) |
| ***C10G 29/24*** | (2006.01) |
| ***C10G 29/06*** | (2006.01) |
| *C10G 29/20* | (2006.01) |
| *C10G 17/09* | (2006.01) |
| *C10G 21/00* | (2006.01) |

(Continued)

(52) U.S. Cl.
CPC ..... *C10G 29/06* (2013.01); *C10G 29/24* (2013.01); *C10G 2300/202* (2013.01)

(58) Field of Classification Search
CPC ..... C10G 17/09; C10G 21/00; C10G 21/12; C10G 21/16; C10G 27/10
See application file for complete search history.

(56) References Cited

U.S. PATENT DOCUMENTS 3,928,211 A 12/1975 Browning et al.
3,983,252 A 9/1976 Buchalter
(Continued)

OTHER PUBLICATIONS

Buller, J., et al., "H2S Scavengers for non-Aqueous Systems," SPE93353, 5 pp, SPE Int'l Symposium on Oilfield Chemistry, Houston, TX (Feb. 2005).

*Primary Examiner* — Brian McCaig
(74) *Attorney, Agent, or Firm* — Mossman Kumar & Tyler PC

(57) ABSTRACT

The use of a composition including a transition metal salt and at least one water-soluble aldehyde or water-soluble aldehyde precursor scavenges $H_2S$ that is present in aqueous fluids (e.g. produced water liquid streams), natural gas and in oil and mixtures thereof (e.g. mixed production streams that contain all three phases) better than either component when used alone. The resulting scavenger combination significantly increases the reaction rate and the overall scavenging efficiency, i.e. capacity over the case where each component is used alone, in the same total amount. Non-limiting examples of the metal salt include zinc or iron carboxylates, and a non-limiting example of a water-soluble aldehyde or water-soluble aldehyde precursor is ethylene glycol hemiformal.

14 Claims, 3 Drawing Sheets

(51) Int. Cl.

| | |
|---|---|
| *C10G 21/12* | (2006.01) |
| *C10G 21/16* | (2006.01) |
| *C10G 17/10* | (2006.01) |

(56) References Cited

U.S. PATENT DOCUMENTS

| | | | | |
|---|---|---|---|---|
| 4,246,243 | A | 1/1981 | Fox | |
| 5,347,004 | A | 9/1994 | Rivers et al. | |
| 6,024,866 | A | 2/2000 | Weers et al. | |
| 6,599,472 | B1 | 7/2003 | Hudson | |
| 7,078,005 | B2 | 7/2006 | Smith et al. | |
| 2004/0096382 | A1* | 5/2004 | Smith | C10L 3/10 423/226 |
| 2008/0039344 | A1* | 2/2008 | Devereux | B01D 53/52 507/103 |

* cited by examiner

SYNERGISTIC H2S SCAVENGER COMBINATION OF TRANSITION METAL SALTS WITH WATER-SOLUBLE ALDEHYDES AND ALDEHYDE PRECURSORS

CROSS-REFERENCE TO RELATED APPLICATIONS

This application claims the benefit of U.S. Provisional Patent Application No. 61/750,973 filed Jan. 10, 2013, incorporated herein by reference in its entirety.

TECHNICAL FIELD

The present invention relates to methods and compositions for scavenging $H_2S$ and/or mercaptans from fluids, and more particularly relates, in one non-limiting embodiment, to methods and compositions for scavenging $H_2S$ and/or mercaptans from fluids using a transition metal salt and a water-soluble aldehyde or a water-soluble aldehyde precursor.

TECHNICAL BACKGROUND

In the drilling, downhole completion, production, transport, storage, and processing of crude oil and natural gas, including waste water associated with crude oil and gas production, and in the storage of residual fuel oil, $H_2S$ and/or mercaptans are often encountered. The presence of $H_2S$ and mercaptans is objectionable because they often react with other hydrocarbons or fuel system components. Another reason that the $H_2S$ and mercaptans are objectionable is that they are often highly corrosive. Still another reason that $H_2S$ and mercaptans are undesirable is that they have highly noxious odors. The odors resulting from $H_2S$ and mercaptans are detectable by the human nose at comparatively low concentrations and are well known. For example, mercaptans are used to odorize natural gas and used as a repellant by skunks and other animals.

The predominant $H_2S$ and mercaptan scavengers for natural gas and crude oil are water soluble monoethanolamine (MEA) triazines and monomethylamine (MMA) triazines. These compounds contain nitrogen and when used in sufficient concentration may cause problems for certain refineries. Glyoxal ($C_2H_2O_2$) or acrolein ($C_3H_4O$) have been used as $H_2S$ scavengers in instances where a nitrogen-containing $H_2S$ scavenger is not desired. Glyoxal is a slow acting scavenger and may be corrosive to mild steel. Acrolein is effective scavenger but an extremely toxic substance which operators do not like to use.

Oil soluble amine formaldehyde reaction products such as the dibutylamine/formaldehyde reaction product have been used previously as hydrogen sulfide ($H_2S$) scavengers. The generic structure of oil soluble amines is given below.

(I)

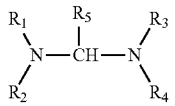

wherein $R_1$, $R_2$, $R_3$ and $R_4$ may be independently a saturated or unsaturated hydrocarbon group, e.g., alkyl, aryl , alkylaryl, alkaryl, cycloalkyl, alkenyl, aralkenyl, alkenylaryl, cycloalkenyl, and the like or heterocyclyl groups and $R_5$ may be hydrogen or lower alkyl.

It would be desirable if a new class of $H_2S$ and mercaptan scavengers could be discovered which is very effective, but which is more efficient and increases the reaction rate as compared with prior scavengers.

SUMMARY

There is provided in one non-limiting embodiment a composition for synergistically scavenging hydrogen sulfide and/or mercaptans from a fluid, where the composition includes at least one transition metal salt, and at least one water-soluble aldehyde or water-soluble aldehyde precursor.

There is additionally provided in one non-restrictive version, a method for scavenging hydrogen sulfide and/or mercaptans from a fluid selected from the group consisting of an aqueous phase, a gaseous phase, a hydrocarbon phase and mixtures thereof. The method involves contacting the fluid with a composition in an effective amount for synergistically scavenging hydrogen sulfide and/or mercaptans. Again, the composition includes at least one transition metal salt, and at least one water-soluble aldehyde or water-soluble aldehyde precursor.

Synergistically scavenging is defined as the amount of hydrogen sulfide and/or mercaptans scavenged is greater as compared with a composition where either the transition metal salt or the at least one water-soluble aldehyde or water-soluble aldehyde precursor is absent, used in the same total amount.

Any of these methods may optionally include corrosion inhibitors including, but not necessarily limited to phosphate esters, acetylenic alcohols, fatty acids and/or alkyl-substituted carboxylic acids and anhydrides, phosphates esters and/or polyphosphate esters, quaternary ammonium salts, imidazolines, sulfur-oxygen phosphates, and the like, and combinations thereof.

DETAILED DESCRIPTION

Figure 1:
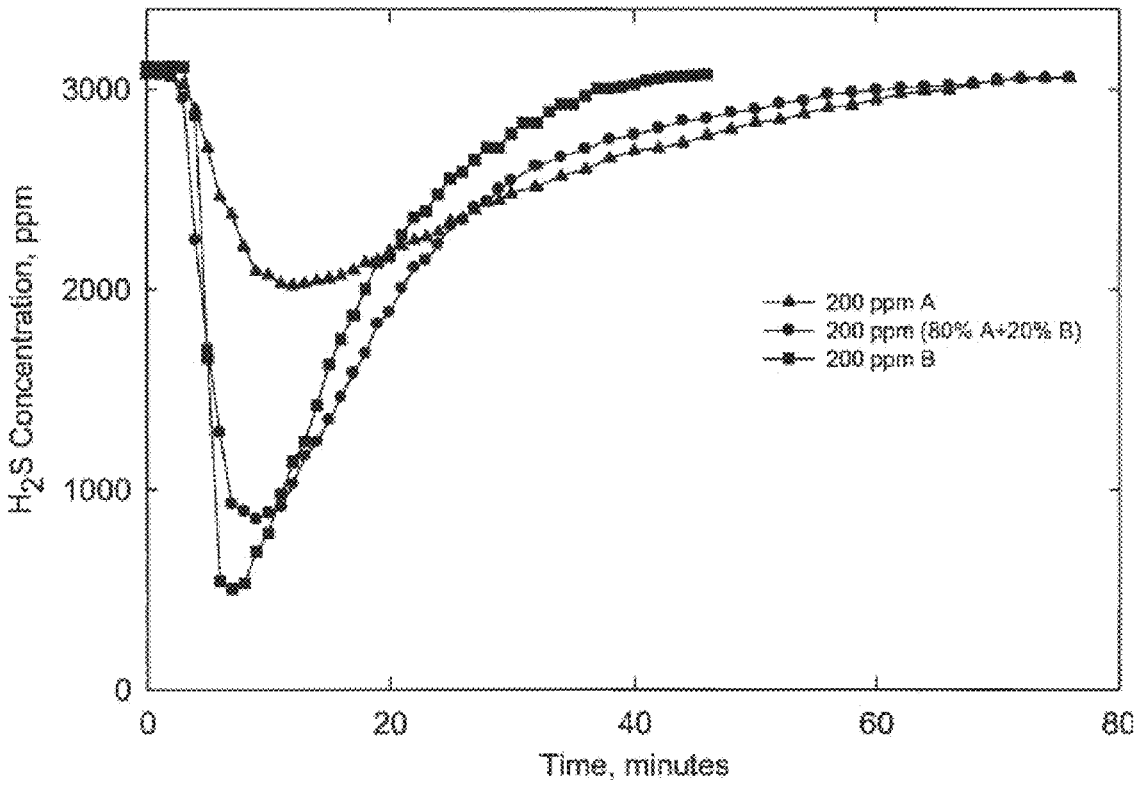
FIG. 1 is a graph of the drop in $H_2S$ concentration as a function of time for different $H_2S$ scavenger components, ethylene glycol hemiformal (A) and zinc octoate (B), and for component combinations.

It has been surprisingly discovered that combinations of transition metal salts and water-soluble aldehydes and/or water-soluble aldehyde precursors remove hydrogen sulfide present in natural gas and in oil more completely and faster than either of the components used alone at the same total concentrations in the mixture, and is thus also expected to remove mercaptans from these fluids as well. The process by which the hydrogen sulfide is effectively removed from gas, water or oil, or combinations thereof, involves introducing a synergistic combination of transition metal salt and water-soluble aldehyde and/or water-soluble aldehyde precursor into the $H_2S$-containing system. The synergistic scavenger combination significantly increases the reaction rate and the overall scavenging efficiency over each of the components used alone, but at the same total amount. The synergy may be seen from the data discussed below.

In specific applications to remove $H_2S$ from crude oil, the hydrogen sulfide/mercaptan scavenger may be introduced in the crude oil (or other fluid) at concentrations from about 1 independently to about 100,000 ppm; in another non-limiting embodiment from about 10 independently to about 10,000 ppm; in a different embodiment from about 25 independently to about 7,500 ppm; alternatively from about 50 independently to about 5,000 ppm. The term "independently" when used in connection with a range means that any lower threshold may be combined with any upper threshold to give a valid or suitable alternative range.

It is expected that many transition metal salts may find at least some utility in the $H_2S$/mercaptan scavenger compositions described herein. However, to give a better understanding, specific examples of suitable metal salts include, but are not necessarily limited to, zinc chloride, zinc acetate, zinc octoate, a zinc salt containing at least one hydrocarbyl group of at least 4 carbon atoms, such as zinc di-(neo-alkyl)-phosphorodithioate, zinc 2-ethylhexyl isopropyl phosphorodithioate, zinc dihydrocarbyldithiophosphates (ZDDP), zinc hydrocarbyl phosphate, zinc ethyl hexanoate (zinc 2-hexanoate), zinc naphthenates, zinc oleate, zinc carboxylate polymers (e.g. catena-2-ethylhexananto-(O,O')-tri-μ-2-ethylhexanato(O,O') dizinc (II)), copper salts, cobalt salts, manganese salts, iron salts such as iron chloride, iron carboxylates (e.g. iron oleate), iron neocarboxylates (e.g. iron 2-ethyl hexanoate), iron naphthenates, ferrocene, molybdenum metal salts, and combinations thereof. One specific suitable example is zinc octoate. In one non-limiting embodiment the metal salts are oil soluble, but it is expected that water soluble (aqueous soluble) metal salts will also be useful. Other transition metal salts including cobalt salts and manganese salts can also be used.

It is also expected that many water-soluble aldehydes or water-soluble aldehyde precursors will be suitable components in the $H_2S$/mercaptan scavenger compositions described herein. But again, to give better understanding, specific examples of suitable aldehydes or water-soluble aldehyde precursors include, but are not necessarily limited to ethylene glycol hemiformal (ethylenedioxydimethanol) , glutaraldehyde, 2 [hydroxyethanol (amino)]ethanol, propylene glycol hemiformal), and combinations thereof. One specific suitable example is ethylene glycol hemiformal. In one non-limiting embodiment, there is an absence of dialdehyde, and/or an absence of glyoxal.

In one non-limiting embodiment, the amount of weight ratio of transition metal salt in the total composition with the water-soluble aldehyde or water-soluble aldehyde precursor (not accounting for any solvent) ranges from about 0.05 wt % independently to about 50 wt %, alternatively from about 5 independently to about 30 wt % transition metal salt. The water-soluble aldehyde or water-soluble aldehyde precursor comprises the balance.

The suitable solvents for the $H_2S$/mercaptan scavenger compositions herein include, but are not necessarily limited to, Aromatic 100, ISOPAR M, kerosene, mineral oil, alcohols, glycols, and mixtures thereof.

It has been discovered that oil-soluble $H_2S$/mercaptan scavenger compositions work well in brine solutions while water-soluble $H_2S$/mercaptan scavenger compositions work well in non-aqueous or oil solutions. This occurs because the reaction is a heterogeneous reaction for the case of the $H_2S$/mercaptan scavenger compositions in water. The actual concentration of the scavenger within the oil droplets in a water or brine solution is relatively high.

It has been surprisingly discovered that the amount of hydrogen sulfide and/or mercaptans scavenged is greater as compared with an otherwise identical composition with respect to transition metal salt, where the water-soluble aldehyde or water-soluble aldehyde precursor is absent and vice versa. This effect is true for the same total amount of active component.

It has been found that oil-soluble formulations of these compounds act as hydrogen sulfide and/or mercaptan scavengers when the hydrogen sulfide and/or mercaptan is present in the aqueous phase, the gaseous phase and a hydrocarbon phase. These methods and compositions may be used to remove hydrogen sulfide and/or mercaptans present in natural gas produced from natural gas wells. They may also be used to remove hydrogen sulfide and/or mercaptans from crude oil. Additionally they may be used to remove hydrogen sulfide and/or mercaptans from brines and other aqueous solutions containing them. Stated another way, the scavenging composition is expected to remove hydrogen sulfide and/or mercaptans in hydrocarbon gas streams, hydrocarbon liquid streams, produced water liquid stream and/or mixed production streams that contain all three phases.

More specifically, the $H_2S$/mercaptan scavengers are expected to be useful in a wide variety of applications, particularly "upstream" and "downstream" applications (upstream and downstream of a refinery) including, but not necessarily limited to, residual fuel oil, jet fuel, bunker fuel, asphalt, recovered aqueous streams, as well as mixed production streams, for instance downhole or downstream of wellhead, including, but not limited to scavenging $H_2S$ and mercaptans from production fluids. Another suitable application may be to remove hydrogen sulfide from a hydrogen stream, and the like. In one non-limiting embodiment the method is practiced in a refinery. The primary applications within a refinery involve hydrocarbon liquid phases and hydrocarbon gaseous phases.

When the method scavenges $H_2S$ and/or mercaptans from a gaseous phase, the method may be practiced by contacting the gaseous phase with droplets of the composition, and/or passing the gaseous phase through the composition, such as by bubbling through a tower.

The scavenging compositions described herein may also include corrosion inhibitors including, but not necessarily limited to, phosphate esters, acetylenic alcohols, fatty acids and/or alkyl-substituted carboxylic acids and anhydrides, phosphates esters and/or polyphosphate esters, quaternary ammonium salts, imidazolines, sulfur-oxygen phosphates, and the like and combinations thereof.

The invention will now be illustrated with respect to certain examples which are not intended to limit the invention in any way but simply to further illustrate it in certain specific embodiments.

EXAMPLE 1

A continuous gas flow apparatus was used to evaluate $H_2S$ scavenger performance. This apparatus involved the sparging of a given composition of gas containing hydrogen sulfide in a vessel containing a liquid hydrocarbon. In the tests described here the liquid was heated at 75° C. and the pressure was 1 atm (0.1 MPa). Gas containing 3000 ppm $H_2S$ and 2% carbon dioxide was sparged continuously through a vessel containing liquid hydrocarbon. The initial concentration of $H_2S$ in the vapor space in equilibrium with liquid hydrocarbon was measured at 3,000 ppm. The concentration of $H_2S$ gas exiting the vessel was measured. The experiments were performed using following solutions:

A: (solution of 100% ethylene glycol hemiformal)

B: (solution of 16% by weight of zinc as zinc octoate in a hydrocarbon solvent)

The drop of $H_2S$ concentration is recorded in ISOPAR M as a function of time for 200 ppm of A, 200 ppm A+B (80% A and 20% B), and 200 ppm of solution B is shown in FIG. 1. Percentages are wt %.

Figures 2, 3:
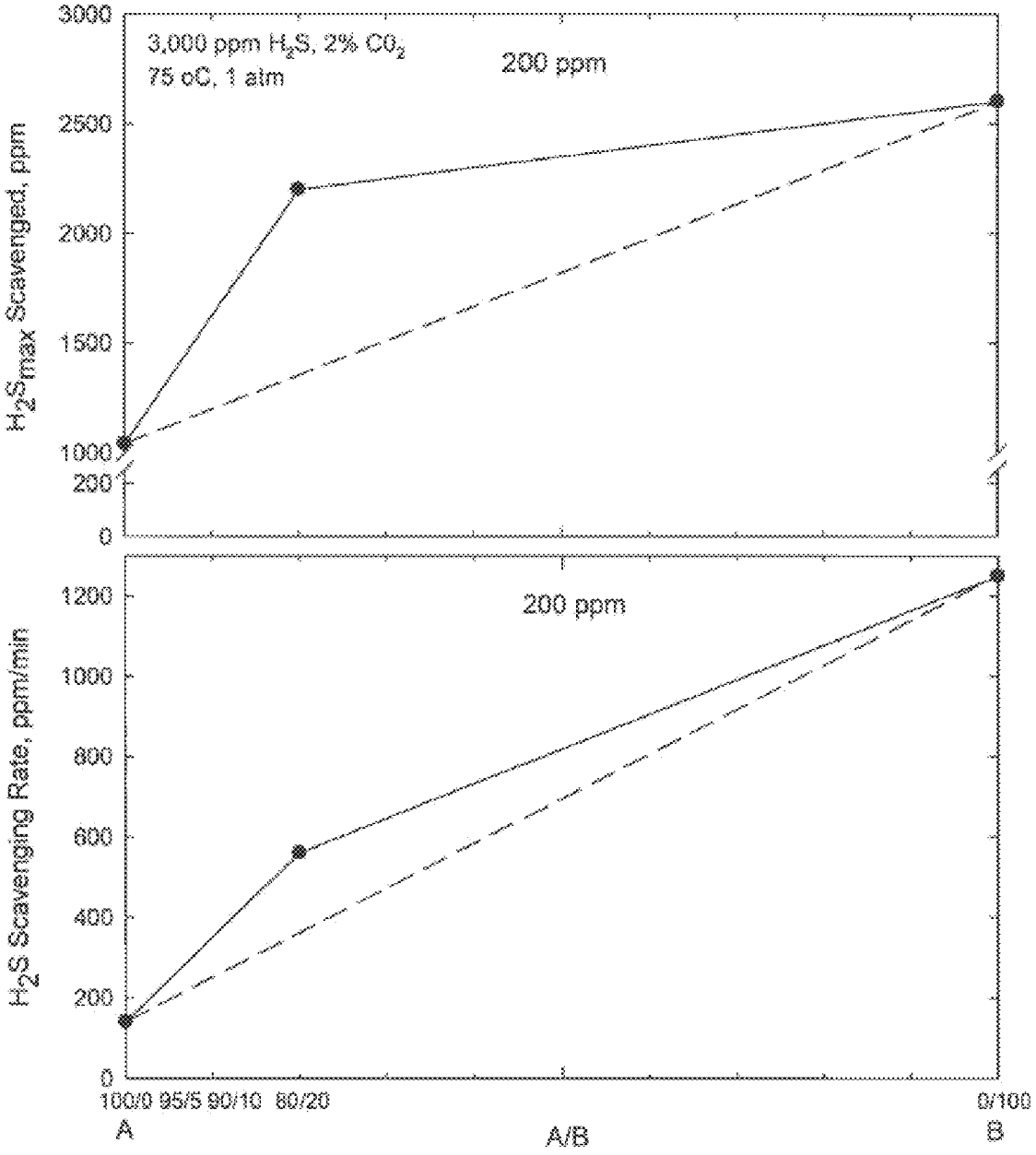
FIG. 2 demonstrates the maximum drop in measured gas phase $H_2S$ concentration (ppm $H_2S$) as a function of different proportions of ethylene glycol hemiformal and zinc octoate.
FIG. 3 is graph showing $H_2S$ scavenging rates as a function of various weight ratios of ethylene glycol hemiformal and zinc octoate.

The results can be described in terms of maximum $H_2S$ scavenged and $H_2S$ scavenging rate for various ratios of component A and component B as shown in FIGS. 2 and 3, respectively. FIG. 2 presents the maximum $H_2S$ scavenged and FIG. 3 presents the $H_2S$ scavenging rate for the different ratios of amine/formaldehyde reaction product (A) and zinc carboxylate (B). The hydrocarbon solvent used was ISOPAR M. It may be seen clearly that the combinations of A and B show synergistic behavior when compared with the pure components and the sum of the components in the mixture. That is, the straight, dashed line in FIGS. 2 and 3 is what would be expected if there was linear behavior in the change from a mixture of only A as the active component to only B as the active component. Instead, better results are obtained with the compositions on the left side of each graph than would be expected from the simple additive effect of using the two components in a total amount that is the same as either component used separately.

FIG. 2 demonstrates the maximum drop in measured $H_2S$ concentration (ppm $H_2S$) in gas phase as a function of % A, and FIG. 3 demonstrates the slope (i.e. rate) of the maximum drop in $H_2S$ concentration with time (drop in ppm $H_2S$/min) as a function of % A.

It may be seen clearly that the combinations of A and B show synergistic behavior for the maximum drop in $H_2S$ concentration and speed of reaction when compared with pure A or B.

Figure 4:
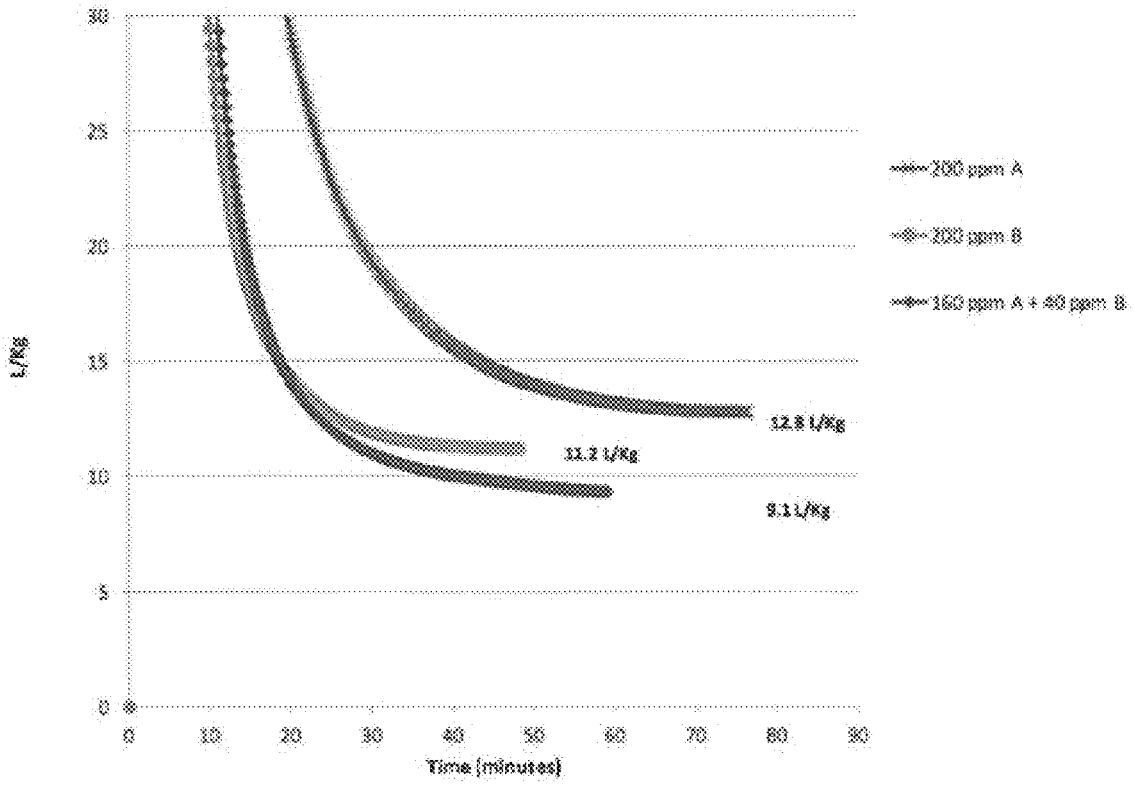
FIG. 4 is graph showing $H_2S$ scavenging efficiency (volume of chemical used/amount of $H_2S$ reacted) as a function of time for a scavenger having different proportions of ethylene glycol hemiformal and zinc octoate.

In addition to the rate of $H_2S$ scavenging, the combination of A and B was also synergistic with respect to the overall scavenging efficiency. FIG. 4 shows the efficiency of each scavenger by integrating the $H_2S$ scavenged over a given time period of the test period from the start of the test and expressing the result in terms of the volume of $H_2S$ scavenger needed to react with one Kg of $H_2S$. The results show that the combination of 160 ppm A and 40 ppm B (80% A/20% B) was clearly synergistic since this combination required 9.1 L/Kg. This is greater efficiency than either A or B which required 12.8 L/Kg and 11.2 L/Kg respectively.

EXAMPLE 2

A continuous gas flow apparatus was used to evaluate $H_2S$ scavenger performance. This apparatus involved the sparging of a given composition of gas containing hydrogen sulfide in a vessel containing a liquid hydrocarbon. In the tests described here the liquid was heated at 75° C. and the pressure was 1 atm (0.1 MPa). Gas containing 3000 ppm $H_2S$ and 2% carbon dioxide was sparged continuously through a vessel containing liquid hydrocarbon. The initial concentration of $H_2S$ in the vapor space in equilibrium with liquid hydrocarbon was measured at 3,000 ppm. The concentration of $H_2S$ gas exiting the vessel was measured. The experiments were performed using following solutions:

A: (solution of 100% ethylene glycol hemiformal)

B: (solution of 16% by weight of zinc as zinc octoate) in a hydrocarbon solvent)

C: (solution of 50% A and 17% B) with 33% solvent

D: (solution of 50% A and 27.5% B) with 22.5% solvent

E: (solution of 65% A and 13.75% B with 5% tertiary amine) with 16.25% solvent

In Table I the specific consumption of the four solutions to scavenge one kilogram of hydrogen sulfide is compared with each other.

TABLE I

Specific Consumption of Solutions A-E

| Solution | % EDDM of Active Material | % (16% Zinc) of Active Material | Concentration of Active Material Used (ppm) | Specific Consumption (L/Kg $H_2S$) |
|---|---|---|---|---|
| A | 100 | 0 | 200 | 9.6 |
| B | 0 | 100 | 200 | 11.1 |
| C | 74 | 26 | 134 | 9.6 |
| D | 64.5 | 35.5 | 155 | 8.2 |
| E | 78 | 16 | 177 | 5.7 |

The table demonstrates that a reduction in the specific consumption of different solutions for a fixed mass of hydrogen sulfide occurs with mixtures of ethylene glycol hemiformal and zinc octoate occurs. The best reduction in specific consumption of the hydrogen sulfide scavenging solution occurs when glycol hemiformal is used with zinc octoate and a tertiary amine (Solution E).

In the foregoing specification, the invention has been described with reference to specific embodiments thereof, and has been demonstrated as effective in providing methods and compositions for scavenging $H_2S$ and/or mercaptans from aqueous fluids, hydrocarbon fluids, gaseous phases and/or combinations thereof. However, it will be evident that various modifications and changes can be made thereto without departing from the broader spirit or scope of the invention as set forth in the appended claims. Accordingly, the specification is to be regarded in an illustrative rather than a restrictive sense. For example, specific transition metal salts, water-soluble aldehydes, water-soluble aldehyde precursors, and solvents falling within the claimed parameters, but not specifically identified or tried in a particular composition or method or proportion, are expected to be within the scope of this invention.

The words "comprising" and "comprises" as used throughout the claims is interpreted as "including but not limited to".

The present invention may suitably comprise, consist or consist essentially of the elements disclosed and may be practiced in the absence of an element not disclosed. For instance, in a method for scavenging hydrogen sulfide and/or mercaptans from a fluid selected from the group consisting of an aqueous phase, a gaseous phase, a hydrocarbon phase and mixtures thereof, the method may consist of or consist essentially of contacting the fluid with a composition in an effective amount for synergistically scavenging hydrogen sulfide and/or mercaptans, where the composition consists of or consists essentially of at least one transition metal salt and at least one water-soluble aldehyde or water-soluble aldehyde precursor, where synergistically scavenging is defined as the amount of hydrogen sulfide and/or mercaptans scavenged is greater as compared with a composition where either the transition metal salt or the water-soluble aldehyde or water-soluble aldehyde precursor is absent, used in the same total amount.

Alternatively, in a composition for scavenging hydrogen sulfide and/or mercaptans from a fluid, the composition may consist of, or consist essentially of, at least one transition metal salt and at least one water-soluble aldehyde or water-soluble aldehyde precursor.

There may be further provided in a non-limiting embodiment, a fluid treated to scavenge hydrogen sulfide and/or mercaptans therefrom, where the fluid consists essentially of or consists of a fluid selected from the group consisting of an aqueous phase, a gaseous phase, a hydrocarbon phase and mixtures thereof, a composition present in an effective amount for synergistically scavenging hydrogen sulfide and/or mercaptans from the fluid, where the composition consists essentially of or consists of at least one transition metal salt, and at least one water-soluble aldehyde or water-soluble aldehyde precursor; where synergistically scavenging is defined as the amount of hydrogen sulfide and/or mercaptans scavenged is greater as compared with a composition where either the transition metal salt or the at least one water-soluble aldehyde or water-soluble aldehyde precursor is absent, used in the same total amount.

What is claimed is:

1. A method for scavenging hydrogen sulfide and/or mercaptans from a fluid selected from the group consisting of a liquid aqueous phase, a liquid hydrocarbon phase, a liquid aqueous phase together with a hydrocarbon gaseous phase, a liquid hydrocarbon phase together with a gaseous hydrocarbon phase, and mixtures thereof, the method comprising contacting the fluid with a composition for synergistically scavenging hydrogen sulfide and/or mercaptans, where the composition comprises:

from about 0.05 wt % to 35.5 wt % of at least one transition metal salt, and ethylene glycol hemiformal in a balance amount where synergistically scavenging is defined as the amount of hydrogen sulfide and/or mercaptans scavenged is greater as compared with a composition where either the transition metal salt or the ethylene glycol hemiformal is absent, used in the same total amount.

2. The method of claim 1 where:

the transition metal salt is selected from the group consisting of zinc chloride, a zinc salt containing at least one hydrocarbyl group of at least 4 carbon atoms, zinc di-(neo-alkyl)-phosphorodithioate, zinc 2-ethylhexyl isopropyl phosphorodithioate, zinc dihydrocarbyldithiophosphates (ZDDP), zinc hydrocarbyl phosphate, zinc ethyl hexanoate, zinc naphthenates, copper salts, cobalt salts, manganese salts, iron chloride, iron carboxylates, iron neocarboxylates, iron naphthenates, ferrocene, molybdenum metal salts, zinc carboxylates, zinc carboxylate polymers and combinations thereof.

3. The method of claim 1 where the composition further comprises a solvent.

4. The method of claim 1 where the effective amount of the composition present in the fluid is from about 10 to about 10,000 ppm.

5. The method of claim 1 where the method is practiced in upstream production.

6. The method of claim 1 where the method is practiced in a refinery.

7. The method of claim 1 where the at least one transition metal salt is selected from the group consisting of zinc carboxylates, iron carboxylates, and combinations thereof.

8. A composition for scavenging hydrogen sulfide and/or mercaptans from a fluid, the composition comprising:

about 0.05 wt % to 35.5 wt % of at least one transition metal salt selected from the group consisting of zinc chloride, a zinc salt containing at least one hydrocarbyl group of at least 4 carbon atoms, zinc di-(neo-alkyl)-phosphorodithioate, zinc 2-ethylhexyl isopropyl phosphorodithioate, zinc dihydrocarbyldithiophosphates (ZDDP), zinc hydrocarbyl phosphate, zinc ethyl hexanoate, zinc naphthenates, copper salts, cobalt salts, manganese salts, iron chloride, iron carboxylates, iron neocarboxylates, iron naphthenates, ferrocene, molybdenum metal salts, zinc octoate, zinc acetate, zinc oleate, zinc carboxylate polymers and combinations thereof; and ethylene glycol hemiformal, in a balance amount.

9. The composition of claim 8 where the composition further comprises a solvent.

10. A fluid treated to scavenge hydrogen sulfide and/or mercaptans therefrom, comprising:

the fluid selected from the group consisting of a liquid aqueous phase, a liquid hydrocarbon phase, a liquid aqueous phase together with a hydrocarbon gaseous phase, a liquid hydrocarbon phase together with a gaseous hydrocarbon phase, and mixtures thereof, a composition for synergistically scavenging hydrogen sulfide and/or mercaptans from the fluid, where the composition comprises:

about 0.05 wt % to 35.5 wt % of at least one transition metal salt, and ethylene glycol hemiformal in a balance amount;

where synergistically scavenging is defined as the amount of hydrogen sulfide and/or mercaptans scavenged is greater as compared with a composition where either the transition metal salt or the is absent ethylene glycol hemiformal, used in the same total amount.

11. The fluid of claim 10 where:

the transition metal salt is selected from the group consisting of zinc chloride, a zinc salt containing at least one hydrocarbyl group of at least 4 carbon atoms, zinc di-(neo-alkyl)-phosphorodithioate, zinc 2-ethylhexyl isopropyl phosphorodithioate, zinc dihydrocarbyldithiophosphates (ZDDP), zinc hydrocarbyl phosphate, zinc ethyl hexanoate, zinc naphthenates, copper salts, cobalt salts, manganese salts, iron chloride, iron carboxylates, iron neocarboxylates, iron naphthenates, ferrocene, molybdenum metal salts, zinc carboxylates, zinc carboxylate polymers and combinations thereof.

12. The fluid of claim 10 where the composition further comprises a solvent.

13. The fluid of claim 10 where the effective amount of the composition present in the fluid is from about 10 to about 10,000 ppm.

14. The fluid of claim 10 where the at least one transition metal salt is selected from the group consisting of zinc carboxylates, iron carboxylates, and combinations thereof.

* * * * *